United States Patent [19]

Kubo et al.

[11] 4,222,522

[45] * Sep. 16, 1980

[54] APPARATUS FOR APPLYING REFRACTORY MATERIAL ONTO THE INNER SURFACE OF A FURNACE

[75] Inventors: Sueki Kubo; Toshiro Watanabe; Masayuki Fujita; Tadahiko Matsuno, all of Kitakyushu; Akira Morita, Ibaragi, all of Japan

[73] Assignee: Kurosaki Refractories Co., Ltd., Kitakyushu, Japan

[ * ] Notice: The portion of the term of this patent subsequent to Oct. 17, 1995, has been disclaimed.

[21] Appl. No.: 889,176

[22] Filed: Mar. 23, 1978

Related U.S. Application Data

[63] Continuation-in-part of Ser. No. 788,941, Apr. 19, 1977, Pat. No. 4,120,260.

[30] Foreign Application Priority Data

| | | | |
|---|---|---|---|
| Apr. 19, 1976 | [JP] | Japan | 51-44759 |
| Nov. 12, 1976 | [JP] | Japan | 51-136733 |
| Nov. 16, 1976 | [JP] | Japan | 51-157018[U] |
| Nov. 24, 1976 | [JP] | Japan | 51-141422 |
| Dec. 1, 1976 | [JP] | Japan | 51-161518[U] |
| Dec. 3, 1976 | [JP] | Japan | 51-145757 |
| Dec. 3, 1976 | [JP] | Japan | 51-162941[U] |
| Dec. 8, 1976 | [JP] | Japan | 51-148048 |
| Dec. 23, 1976 | [JP] | Japan | 51-173401[U] |
| Jan. 20, 1977 | [JP] | Japan | 52-6182[U] |
| Feb. 7, 1977 | [JP] | Japan | 52-12679 |
| Feb. 15, 1977 | [JP] | Japan | 52-17727[U] |
| Mar. 28, 1977 | [JP] | Japan | 52-38147[U] |

[51] Int. Cl.[2] ..... B05B 3/14; B05C 7/02

[52] U.S. Cl. ..... 239/160; 134/167 R; 134/181; 239/165; 239/172; 239/227; 266/201

[58] Field of Search ..... 239/132.3, 132.5, 160, 239/164, 165, 172, 175, 176, 187, 226, 227, 264; 264/30; 266/281; 118/306, 317, 318, 323; 134/167 R, 168 R, 180, 181

[56] References Cited

U.S. PATENT DOCUMENTS

| | | | |
|---|---|---|---|
| 3,074,649 | 1/1963 | Atkinson | 239/227 X |
| 3,477,178 | 11/1969 | Hulbert, Jr. | 134/167 R X |
| 3,917,170 | 11/1975 | Marino | 118/317 X |
| 4,013,518 | 3/1977 | Miko | 239/227 X |
| 4,106,760 | 8/1978 | Kono et al. | 266/281 |

*Primary Examiner*—Andres Kashnikow
*Attorney, Agent, or Firm*—Jordan and Hamburg

[57] ABSTRACT

In an apparatus which applies refractory material in either wet or dry form onto the inner surface of a furnace by means of a spray pipe, a rotating mechanism for rotating the spray pipe is provided with an automatic oscillating device for automatically effecting a continuous oscillation of the spray pipe, the continuous oscillation improving the operability of the spraying operation while uniformly applying an optimal amount of refractory material onto the inner surface of the furance.

3 Claims, 14 Drawing Figures

APPARATUS FOR APPLYING REFRACTORY MATERIAL ONTO THE INNER SURFACE OF A FURNACE

This is a Continuation-in-Part application of Ser. No. 788,941 filed Apr. 19, 1977, now U.S. Pat. No. 4,120,260.

BACKGROUND OF THE INVENTION

This invention relates to an apparatus for applying a lining of refractory material, cement, heat-insulating material or other insulating materials over the refractory layers of a converter or a furnace including an electric furnace and an open-hearth furnace or a vessel with great mobility and efficiency.

In conventional lining operations, the lining material is generally produced at a location remote from the lining operation site and then is transferred to the operation site by means of a long compression supply tube wherein the long floor-laid tube hampers the movement of the lining device when it must move from one converter to another, resulting in an inefficient lining operation.

Furthermore, since the water storage tank, refractory material tank, compressor and the like which are required in the lining operation occupy a large floor area, the operation cannot be conducted efficiently or with adequate mobility.

In addition, these devices are usually located in spaced apart locations so that a central control system for the spraying apparatus is hard to achieve. Therefore, at least several workers are required to operate the apparatus.

Meanwhile, in the lining operation, the lining apparatus is moved to a position adjacent to the upper open end of the furnace. Subsequently, the long spray pipe is extended into the furnace and the spray nozzle attached to the extremity of the spray pipe is directed toward the abraded or eroded portion of the furnace lining and the desired amount of refractory material is sprayed onto the above portion so as to repair the lining of a furnace.

In this case, the operator controls the spray pipe while observing the movement thereof.

However, the mere manipulation of the spray pipe is often inadequate to insure coverage of all of the abraded portion on the furnace lining because they are not all within the sprayable range of the spray pipe.

For example, as shown in FIG. 14, when the spray nozzle is directed from one abraded portion to another in some cases the spray pipe will come into contact with the upper periphery of the furnace if the lining apparatus is kept in the same position. In these cases, the apparatus as a whole must be moved a certain distance to prevent breaking the spray pipe. The operation to move the apparatus conventionally requires that the operator get off the apparatus or shift his position on the apparatus thereby making the operation very cumbersome.

Furthermore, since the rotation of the spray pipe is effected manually by an ON-OFF switching operation, it is hardly possible to apply a refractory material uniformly or efficiently onto the abraded or eroded portion of a considerably large area. It is also considerably difficult for an operator to conduct two operations simultaneously, namely reciprocation and occilation of the spray pipe.

Accordingly, it is an object of the present invention to provide an apparatus for applying a lining onto the inner surface of a furnace which overcomes the aforementioned disadvantages and which is capable of conducting the lining operation with great mobility and efficiency.

It is another object of the present invention to provide an apparatus for applying a lining onto the inner surface of a furnace wherein the spray nozzle can uniformly and efficiently apply refractory material onto the eroded or abraded portion of the inner surface of a furnace or vessel.

It is still another object of the present invention to provide an apparatus for applying a lining onto the inner surface of a furnace that includes a central control system with which an operator can manipulate all the devices mounted on the transport car easily and precisely.

It is still another object of the present invention to provide an apparatus for repairing the lining of a furnace by means of which the entire spraying operation including the manipulation of the spray pipe as well as the steering of the transport car can be conducted by a single operator while sitting on the seat mounted on the apparatus throughout the spraying operation.

DETAILED DESCRIPTION OF THE INVENTION

Figure 1:
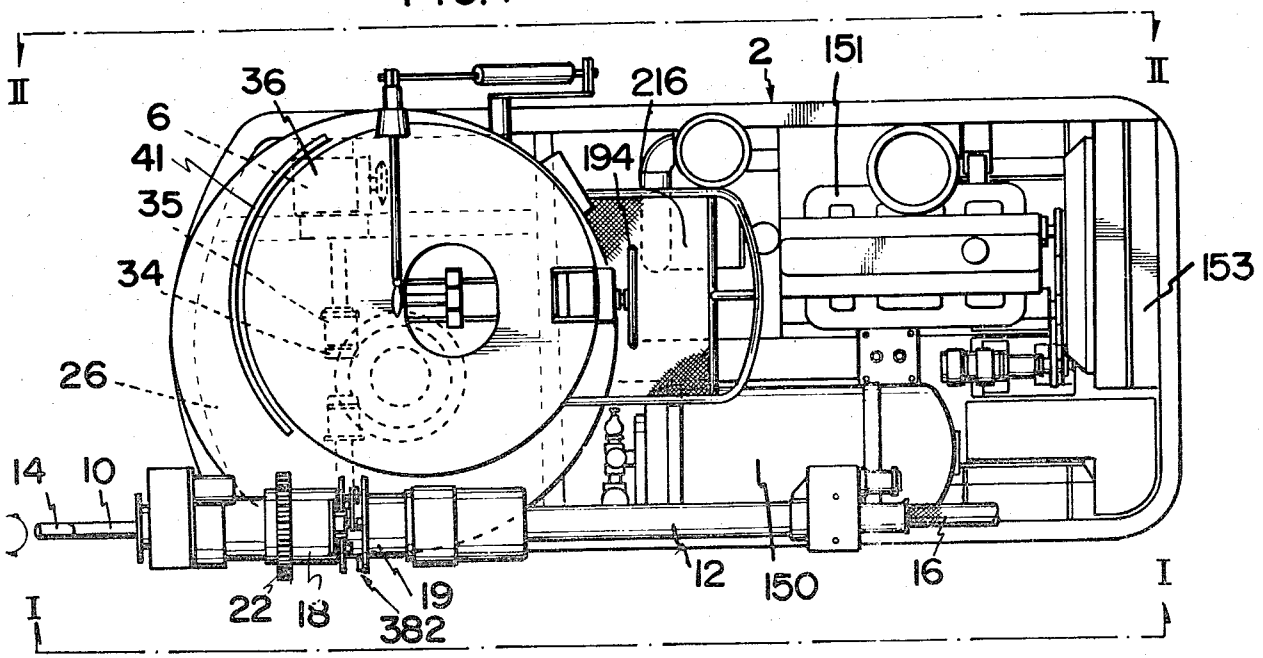
FIG. 1 is a top plan view of the basic construction of the apparatus of this invention.
Figure 2:
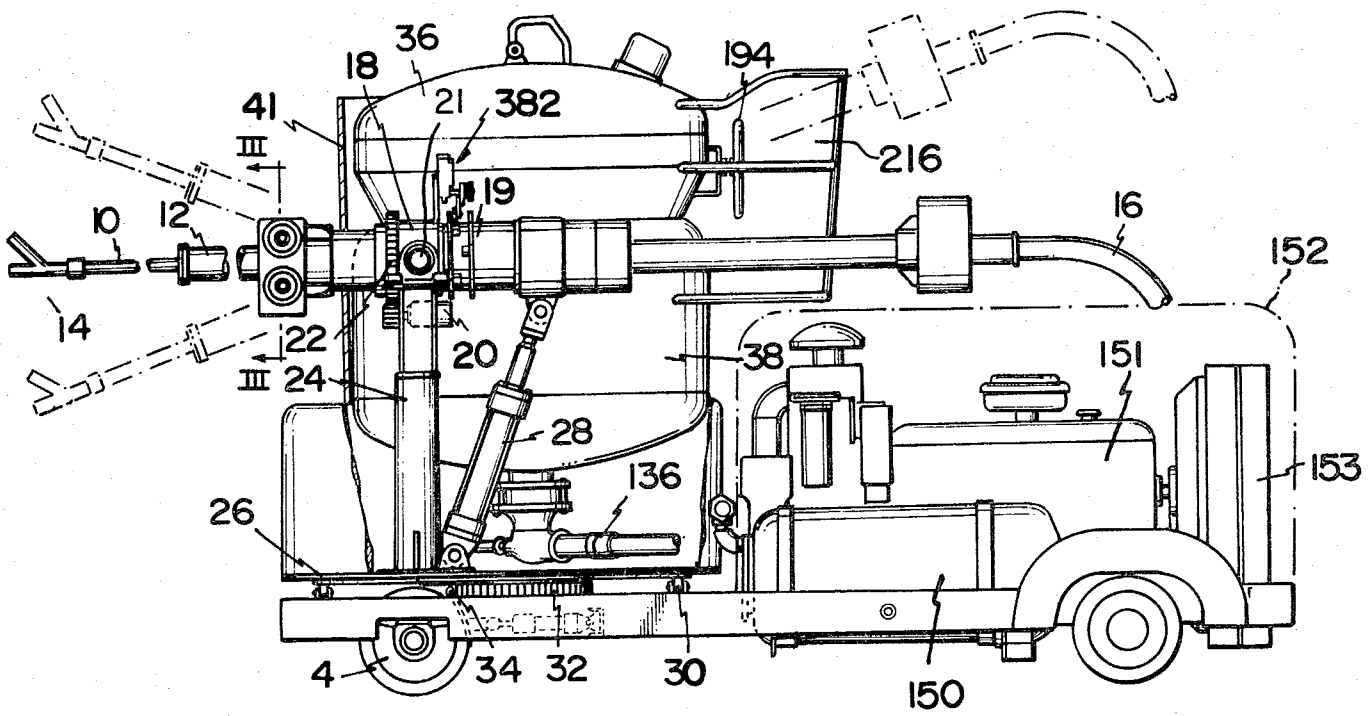
FIG. 2 is a side view taken along the line I—I of FIG. 1.
Figure 3:
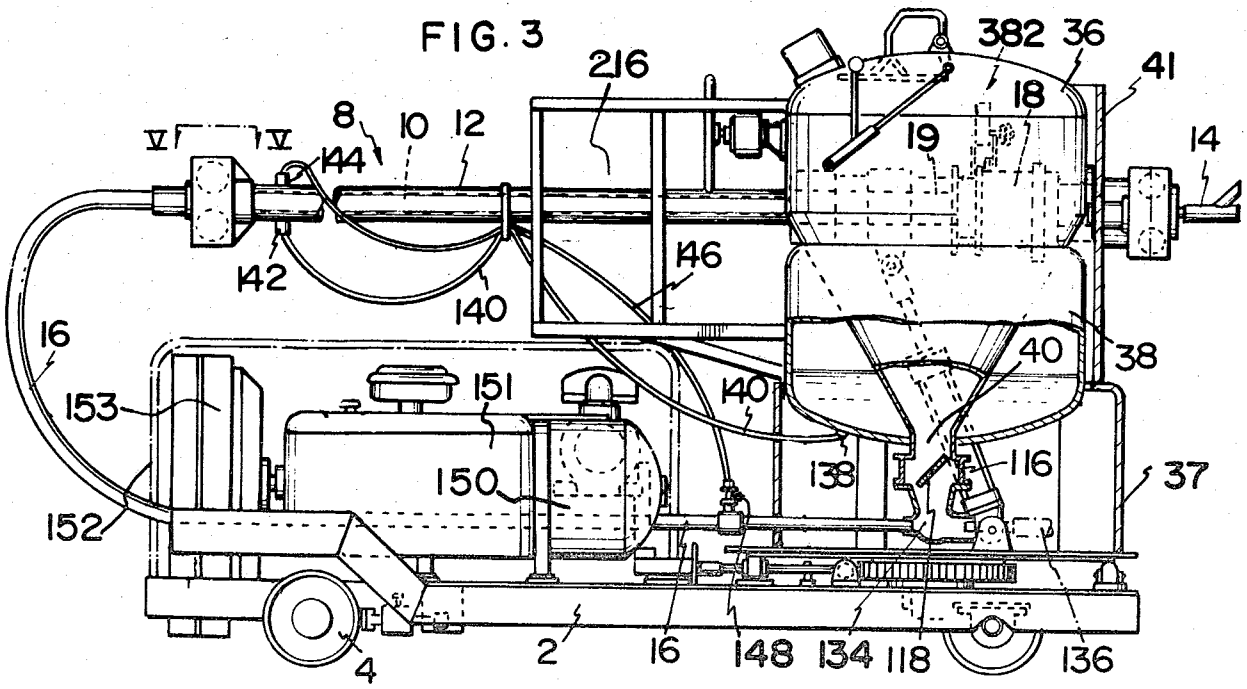
FIG. 3 is another side view partially broken away and taken along line II—II of FIG. 1.

The basic structure of the lining apparatus of this invention is first described. Referring to FIG. 1 through FIG. 3, there is shown a transport car 2 provided with wheels 4 driven by hydraulically-operated motors so that the car 2 is movable both backwards and forwards. Above and substantially parallel to the transport car 2, there is shown a spray pipe 8 consisting of an inner pipe 10 and an outer pipe 12.

The inner spray pipe 10 is provided with a spray nozzle 14 at the front extremity thereof and has the rear end thereof tightly connected with one end of a flexible hose 16 through which refractory material in either dry or wet form is supplied thereto.

The other end of the flexible hose 16 is connected to a refractory material supply source which is described later. The inner spray pipe 10 is slidably disposed inside the outer spray pipe 12 such that spray pipe 8 as a whole can be extended in a telescopic manner while the outer spray pipe 12 is rotatably and slidably disposed within a cylindrical member or body 18 which is disposed substantially at the front of the transport car 2. A power-operated motor 20 and a gear mechanism 22 which are both attached to the cylindrical body 18 cause the rotation of the outer spray pipe 12 by way of a rotating boom 19. The rotating boom 19 forms a part of the cylindrical body 18.

This cylindrical body 18 is tiltably mounted by means of a pivot shaft 21 on the top of a vertical support structure 24 which in turn has the bottom end fixedly secured to the upper surface of a turntable 26. A hydraulic cylinder 28 is diagonally disposed on the turntable 26 for the purpose of tilting the cylindrical body 18. This turntable 26 is supported by a plurality of roller means 30 which are disposed in a circle at the lower periphery of the turntable 26.

The turntable 26 further includes a worm wheel 32 which meshes with a worm 34. The worm 34 is driven by a suitable driving means 35, such as a power-operated motor, so as to rotate the turntable 26 by way of the worm wheel 32.

On the turntable 26, a storage tank 36 for powder-like refractory material and another storage tank 38 for water are mounted by means of support columns 37 such that the vertical axes of the tanks are aligned with the axis of the turntable 26. These tanks 36 and 38 are concentrically disposed one within the other such that the discharge outlet of the conical-shaped refractory material tank 36 is disposed just below the center of the bottom of the water storage tank 38.

A heat insulating shield 41 is provided in front of the tank means.

Below the outlet 40 of the tank 36, a flow regulating valve 116 is disposed which regulates the amount of refractory material to be supplied to the flexible hose 16.

The flow regulating valve 116 has an opening at the lower end thereof which, in turn, communicates with the flexible hose 16 through which the refractory material is charged to the inner spray pipe 10.

In order to give flow energy to the refractory material which passes through the flexible hose 16 and the inner spray pipe 10, an air jet gun 136 is provided at the lower end of the flow regulating valve 116 disposed opposite to the opening 134. This air jet gun may be provided at any suitable position of either the flexible hose, the spray pipe or the spray nozzle.

The water storage tank 38 has a water outlet 138 at the bottom thereof which is connected to one end of a cooling water supply tube 140. The cooling water supply tube 140 has its other end connected to an inlet opening 142 formed in the outer spray pipe 12 at a location so that the water charged into spray pipe 8 cools the entire spray pipe 8 which is subjected to high radiation heat temperatures during the spraying operation.

The outer spray pipe 12 has another water outlet opening 144 which is connected to one end of a warm water return tube 146 wherein the water warmed during the circulation thereof within the spray pipe 8 is discharged into the return tube 146 by way of the outlet opening 144.

The return tube 146 has its other end connected to the flexible hose 16 at the middle thereof by way of a three-port valve 148 wherein the warmed water which passes through the return tube 146 is mixed with the powder-like refractory material to produce refractory material in a wet slurry form which is charged into the inner spray pipe 10 by way of the flexible hose 16.

At the rear of the transport car 2, an air compressor 150 is provided which supplies compressed air to the air jet gun 136, the water storage tank 38, the refractory-material storage tank 36 and other parts of the apparatus which require compressed air. A diesel engine 151 for moving the transport car 2 is also mounted at the rear portion on the transport car 2 along with its radiator 153.

This air compressor 150 and the diesel engine 151 are both protected form dust and the like by a cover means 152.

Figure 4:
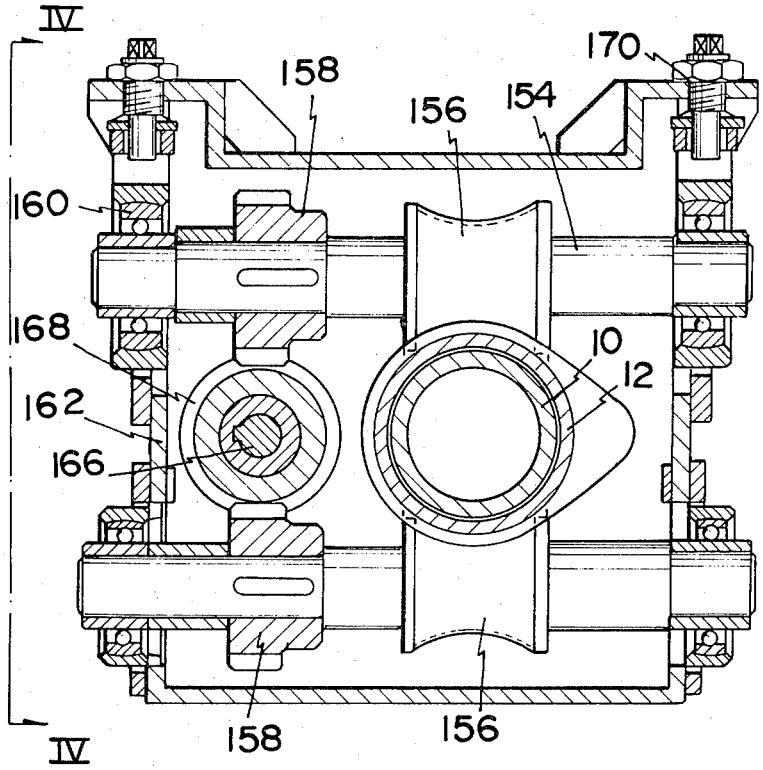
FIG. 4 is an enlarged transverse cross-sectional view of slide means for sliding the outer spray pipe taken along the line III—III of FIG. 2.
Figure 5:
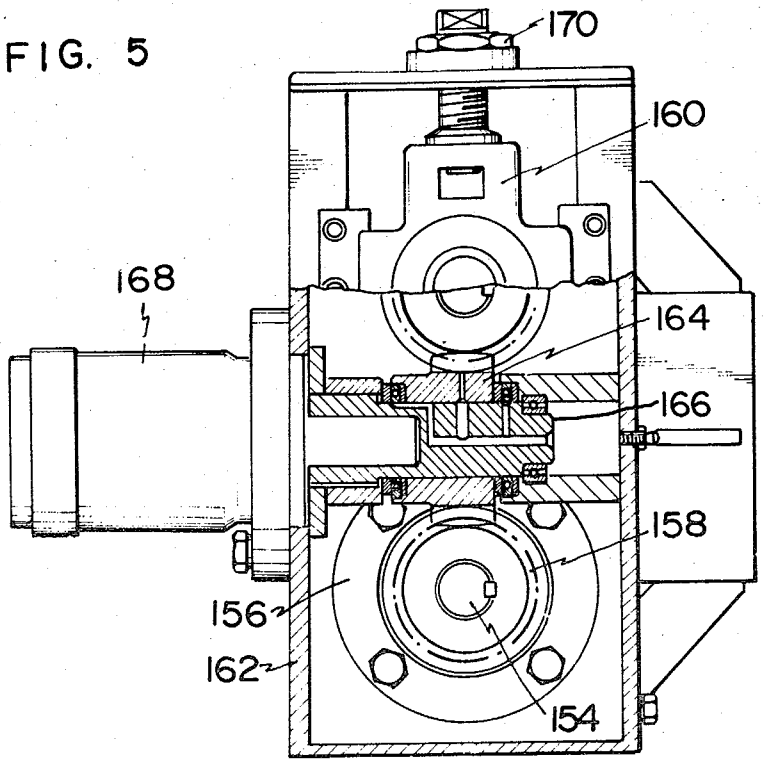
FIG. 5 is a side view of the slide means taken along the line IV-13 IV of FIG. 4.

In FIG. 4 and FIG. 5, the mechanism to slidably move the outer pipe 12 relative to the tiltable cylindrical body 18 is shown wherein each roller shaft 154 which fixedly carries a pipe-propelling roller 156 and a spiral gear 158 in series has both ends thereof journalled by ball bearings 160 which, in turn, rest within openings formed in the side walls of a casing 162. A spiral gear 164 which is fixedly mounted on a drive shaft 166 of a power-operated motor 168 is meshed with spiral gears 158 so that the actuation of the motor 168 causes the rotation of the pipe-propelling rollers 156 which, in turn, move the outer spray pipe 12 forward or backward within and relative to the cylindrical body 18.

Pressure to pinch the outer spray pipe 12 by the two opposing rollers 156 is adjusted by a bolt and nut means 170 disposed adjacent each ball-bearing 160.

Figure 6:
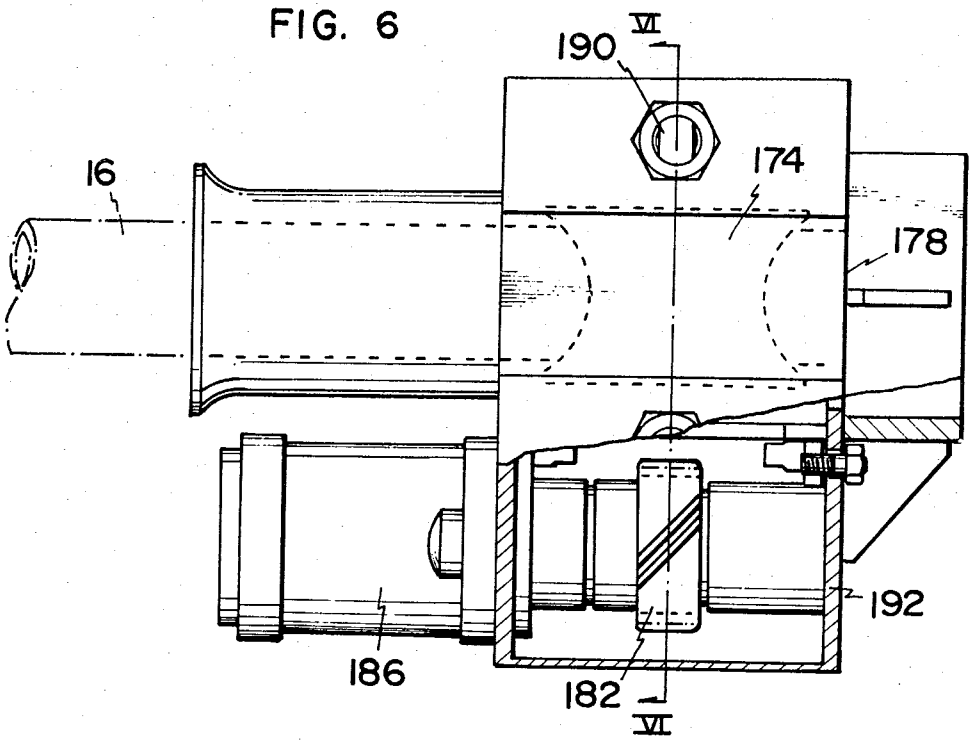
FIG. 6 is an enlarged plan view of slide means for sliding the inner spray pipe relative to the outer spray pipe taken along the line V—V of FIG. 3.
Figure 7:
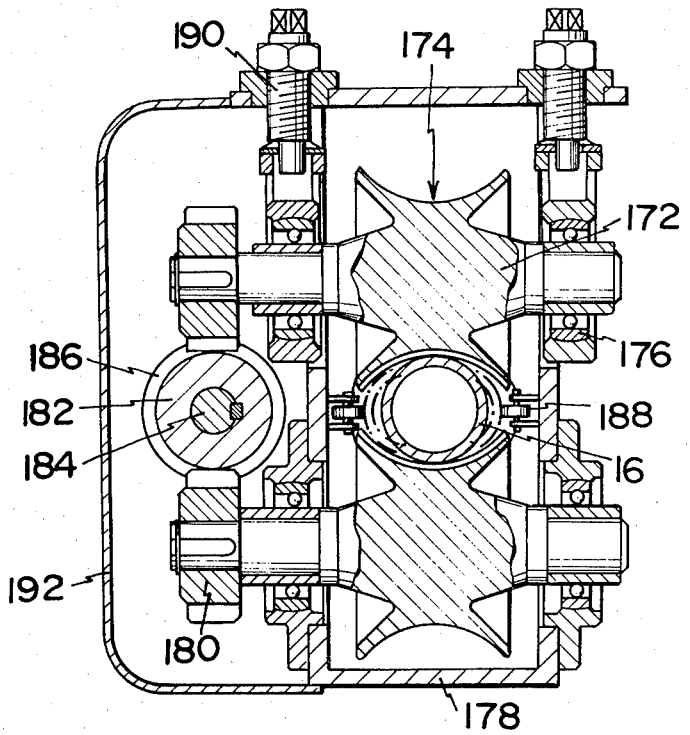
FIG. 7 is a longitudinal cross-sectional view of the slide means taken along the line VI—VI of FIG. 6.

In FIG. 6 and FIG. 7, the mechanism to slidably move the inner spray pipe 10 relative to the outer spray pipe 12 is shown wherein each of a pair of parallely-disposed roller shaft 172 are integrally provided with a second pipe-propelling roller 174 and have both ends journalled by ball bearings 176 which rest in openings formed in the side walls of a casing 178. Each roller shaft 172 is further provided with a spiral gear 180 at the extension adjacent to one journalled portion thereof. A spiral gear 182 which is fixedly mounted on a rotating shaft 184 of a power-operated motor 186 is meshed with spiral gears 180 so that the actuation of the motor 186 causes the rotation of the second pipe-propelling rollers 174 which, in turn, slidably move the inner spray pipe 10 forward or backward within and relative to the outer spray pipe 12.

To be more specific and exact, the second pipe-propelling rollers 174 pinch the flexible hose 16 (not the inner spray pipe 10) as can be observed from FIG. 7. When the above rollers 174 are rotated by the activation of motor 186, the flexible hose 16 which is now depressed in an elliptical hollow cross section is moved longitudinally in either forward or backward direction due to the friction at the inner-surface of rollers 174 and flexible hose 16.

As described previously, since the hose 16 is connected with the inner spray pipe 10, the inner spray pipe 10 moves backwards or forwards longitudinally along with the flexible hose 16.

The casing 178 is also provided with two opposing side rollers 188 which rotatably come into contact with the expanded or distended round side of the hose 16 so as to guide the hose 16.

The pressure to pinch the flexible hose 16 by the two opposing rollers 174 is adjusted by a bolt and nut means 190 disposed above each ball bearing 176. Spiral gears 180 and 182 are protected from dust or the like by a cover means 192 which is fixedly attached to the outer spray pipe 12 together with the casing 178.

Figure 8:
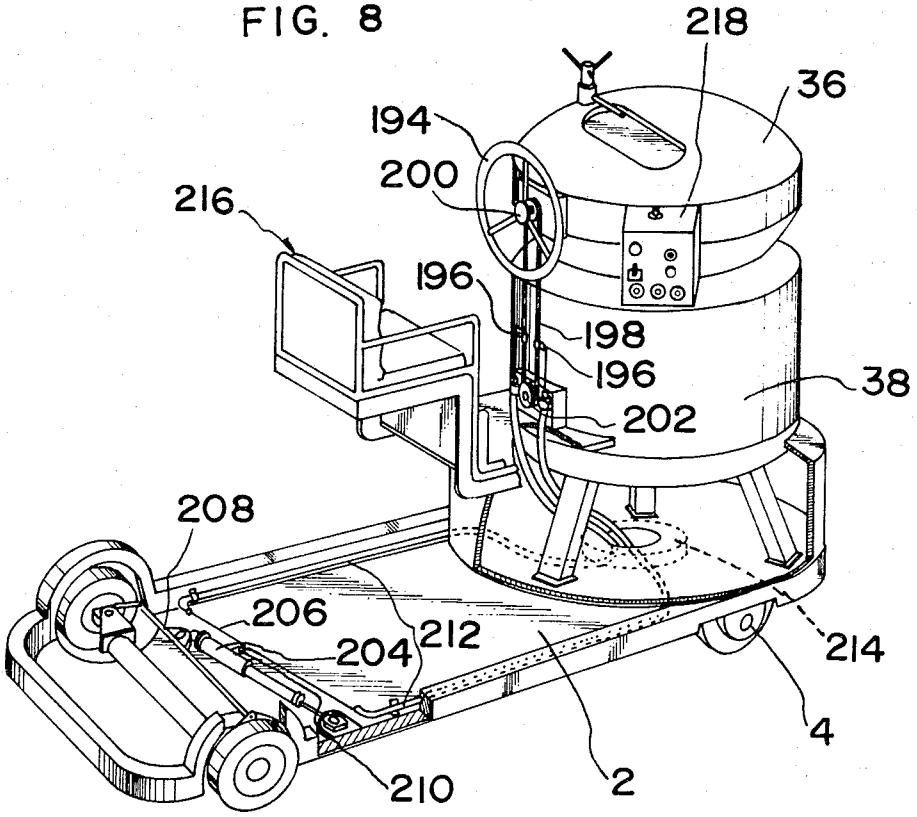
FIG. 8 is a schematic view of the skeleton structure of the lining apparatus showing the mechanism for steering the transport car.

Referring to the means for controlling the apparatus of this shown in FIG. 8, a steering wheel 194 which steers the transport car 2 hydraulically by manipulating the rear wheels 4 is disposed adjacent to the upper portion of the refractory-material storage tank 36.

The mechanism to steer the transport car 2 has the following construction.

In FIG. 8, two lugs 196 which vertically move in opposite directions by the rotation of the steering handle 194 are attached to an endless chain 198 which is extended between a steering handle shaft 200 and a follower shaft 202. These lugs 196 are connected with a hydraulic power steering unit 204 by means of throttling wires 206. This power steering unit 204 which can steer the rear wheels 4 has one end connected with a rear-wheel steering link 208 and the other end pivotally secured to the frame of the transport car 2. Referring to other parts of this mechanism, numeral 210 indicates a throttling lug to which throttling wires 206 are connected, numeral 212 indicates casing tubes which slidably enclose throttling wires 206 and numeral 214 indicates a hollow rotary shaft for running the electric connections and hydraulic circuits as well as throttling wires.

A steering seat 216 on which an operator sits to control the spray pipe as well as the lining device per se is fixedly secured to a rotatable means on a turntable mounted on a lining car. The operator effects such control by manipulating a control panel 218 mounted on the top of the storage tank 36.

Figure 9:
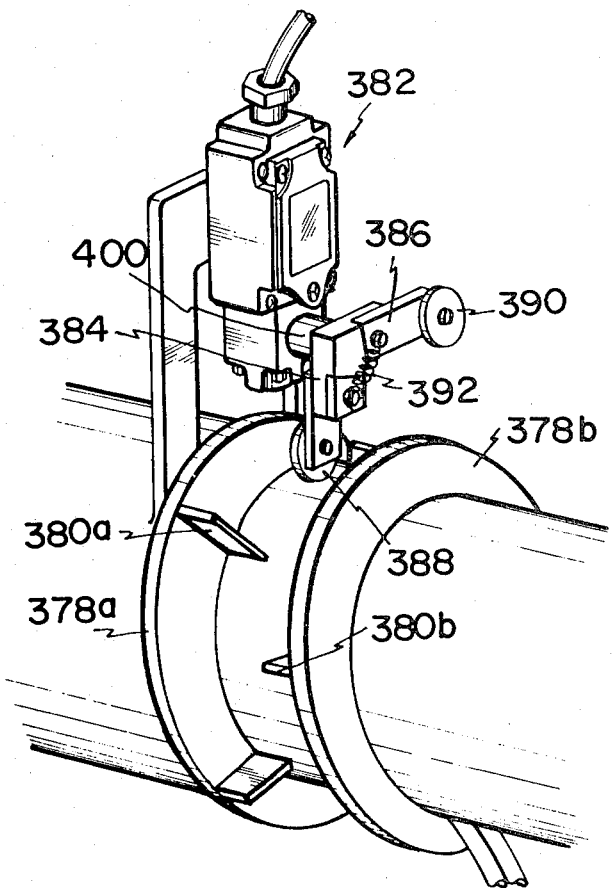
FIG. 9 is an enlarged explanatory view showing the mounting position of the oscillating means on the cylindrical body.
Figure 11:
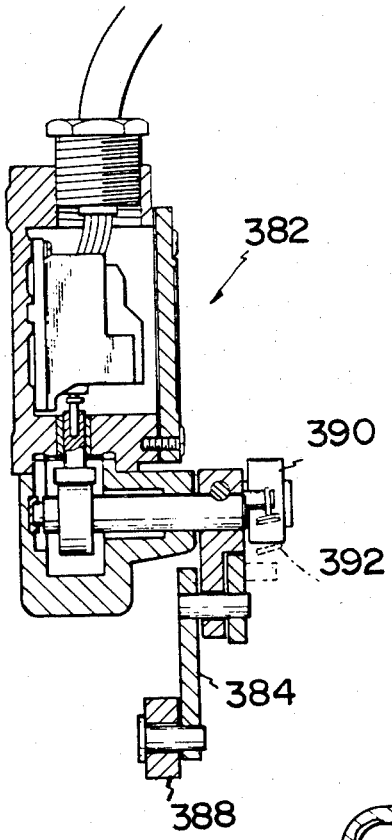
FIG. 11 is a cross-sectional side view of the above limit switch taken along the line VII—VII of FIG. 10.
Figure 10:
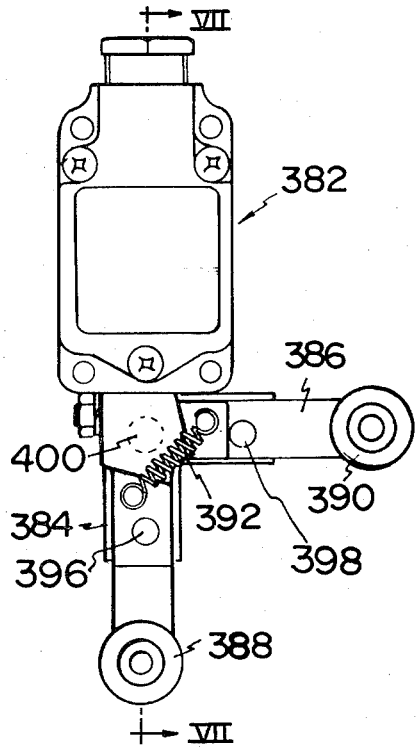
FIG. 10 is a front view of a limit switch employed in the above oscillating means.
Figure 14:
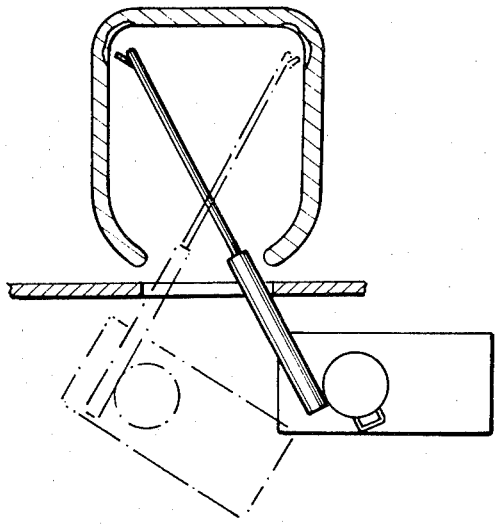
FIG. 14 is an explanatory view showing the lining apparatus in two operating positions.

The construction of the oscillating means which features the present invention is now described hereinafter in conjunction with FIG. 9 through FIG. 11, especially FIG. 9 which shows the detail thereof.

In the drawings, two spaced-apart circular ring plates 378*a* and 378*b* are formed onto the outer shooting pipe 12 adjacent to the pivot pin 21 which tiltably connects the cylindrical body 18 to the support column 24. Each ring plate 378*a* or 378*b* has a plurality of contacting pads 380*a* or 380*b* secured equidistantly circumferentially on the sides thereof which faces the corresponding side of the other ring plate. A fork-lever-shaped limit switch 382 which is provided with two pressure detecting levers 384, 386 is fixedly mounted on the top of the cylindrical body 18 such that one detecting lever 384 is disposed in the rotational path of the row of contacting pads 380*a* while detecting lever 386 is disposed in the rotational path of the row of connecting pads 380*b*.

The limit switch 382 which is especially applicable to the oscillating means of this embodiment further comprises contact rollers 388 and 390 attached to respective ends of the levers 384 and 386 and spring means 392 which tends to position the levers 384 and 386 in alignment with the body of the limit switch 382 unless no contact pressure is applied to the contact rollers 388 and 390.

In this embodiment, when the outer shooting pipe 12 is rotated relative to the cylindrical body 18 by the actuation of the motor 20 and gear mechanism 22, the contacting pad 380*a* disposed on the side of one ring plate 378*a* comes into contact with the corresponding contact roller 388 of the limit switch and subsequently rotates the pressure detecting lever 384. When the lever 384 is rotated 90 degrees, the limit switch 382 initiates the rotation of the outer spray pipe 12 in the reverse direction.

The continued reverse rotation then causes the contacting pad 380*b* on the side of ring 378*b* to contact with the corresponding contact roller 390 of the limit switch 382, and subsequently the limit switch 382 stops the reverse rotation after rotating the lever 386 by 90 degrees and starts the rotation of the outer cylindrical body 12 in the previous or first direction.

In this manner, the shooting pipe is oscillated periodically by a predetermined rotating or oscillating angle.

In FIG. 1, the spray nozzle 14 which has its opening directed in an upward direction is oscillated a desired angle for applying the refractory material onto the inner upper portion of the furnace lining uniformly.

However it must be noted that the oscillating device provides the above oscillating movement of the shooting pipe regardless of the direction of the spraying opening of the spray nozzle.

Namely, when the inner lower portion of the furnace lining is required to be repaired, the spray nozzle must be directed from the upward position to the lower position.

In this case, the supply of electricity to the limit switch 382 is interrupted so as not to energize the limit switch 382 even when its contact roller come into contact with the contact pad by the rotation of the outer spray pipe 12. For facilitating the above rotation of the outer shooting pipe 12 and also for preventing the breaking of the limit switch 382, the limit switch 382 is provided with two auxiliary pivot shafts 396 and 398 and a common shaft 400 which pivotally connects corresponding proximal ends of the two right-angled levers 384 and 386.

Each auxiliary pivot shaft is constructed such that it allows only one-way pivoting of the pressure detecting lever.

Due to the above construction, even when the vertically disposed contact roller of the inoperative limit switch 382 is pressed rearwardly by the trains of contacting pads 380*a* on one side of the ring-like plate 378, the outer spray pipe 12 is rotated without breaking the lever 384 since the rotation of the lever 384 on the auxiliary shaft 396 allows the advancement of above contacting pads.

Accordingly, since the spray pipe is capable of oscillating in addition to rotating, tilting and sliding, the spraying operation by the lining apparatus of this invention is further enhanced.

Figure 12:
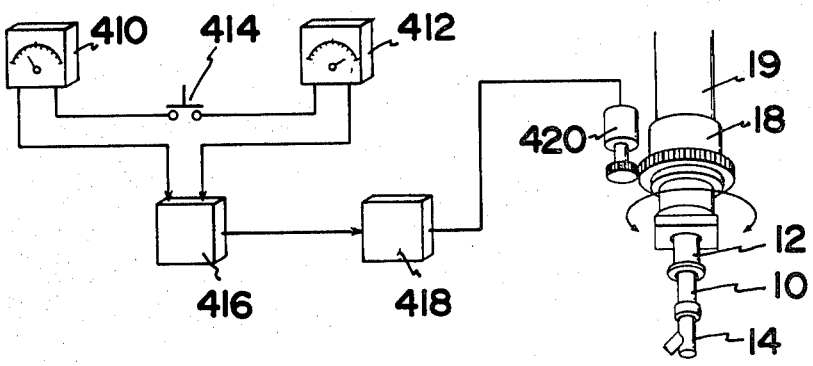
FIG. 12 is a schematic view of a modification of the above oscillating means.

A modification of the above oscillating means is schematically shown in FIG. 12.

The modification is substantially characterized by employing a pair of timers for providing the oscillation of the spray pipe.

In operation, a timer 410 for clockwise rotation and a timer 412 for counter clockwise rotation are preset. Subsequently with the actuation of an ON-OFF switch 414, the clockwise timer 410 transmits an operating signal to a control box 416 where a solenoid valve enclosed in the box 416 is energized and accordingly a hydraulic unit 418 and a hydraulic motor 420 which imparts and maintains the clockwise rotation of the spray pipe 8 until the preset operating time of the timer 410 runs out. As soon as the timer 410 is up, the counter-clockwise timer 412 transmits an operating signal to the control box 416 and eventually imparts the counter-clockwise rotation of the spray pipe 8.

The above clockwise and counter-clockwise rotations are repeated automatically thus enabling the continuous oscillation of the rotation of the spray pipe 8.

Figure 13:
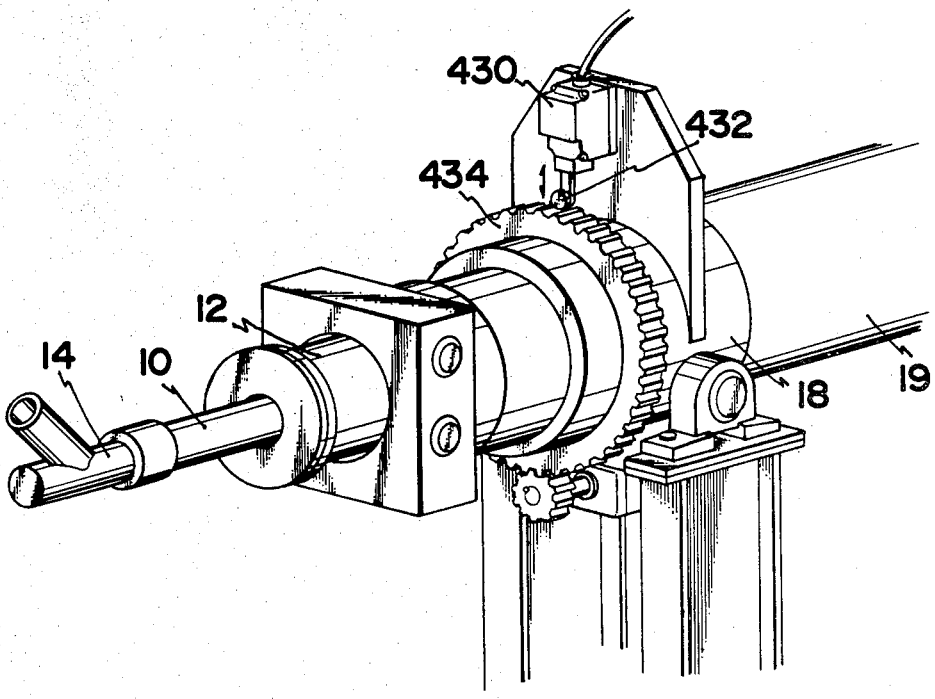
FIG. 13 is a schematic view of a modification of the above oscillating means.

Another modification of the oscillating means is schematically shown in FIG. 13.

The modification is substantially characterized by employing a combination of a toothed wheel and a limit switch which counts the number of teeth.

In operation, a limit switch 430 is fixedly secured to the cylindrical body 18 in an upright position as shown in FIG. 13 wherein a roller follower 432 of the limit switch is placed on the teeth face of a toothed wheel 434. As the spray pipe 8 is rotated in a clockwise direction by a suitable motor (not shown in the drawings), the teeth cause the "up and down" movement of the roller follower 432. The limit switch 430 is electrically connected with a counter (not shown in the drawings) which counts the number of above "up and down" signals transmitted from the limit switch 430. When the counter counts the preset number of "up and down" signals from the limit switch 430, the counter transmits an operating signal to the motor to stop and initiates the reverse or counter-clockwise rotation of the spray pipe 8. The above clockwise and counter-clockwise rotations are repeated automatically thus enabling the continuous oscillation of the rotation of the spray pipe 8.

The manner in which the apparatus of this invention is operated is as follows.

The powder-like refractory material is discharged from the hopper-like storage tank 36 by compressed air supplied from the air compressor 150 and the flow amount is regulated by the flow regulating valve 116. The discharged refractory material is conveyed through the flexible hose 16 with flow energy applied by the air jet from the air jet gun 136. The powder-like material subsequently passes through spray pipe 8 and eventually is sprayed from the spray nozzle 14.

If the refractory material is required in a wet slurry form, the water which is supplied to spray pipe 8 from the water storage tank 38 for cooling the spray pipe 8 is available. Namely, the cooling water is discharged from the water storage tank 38 by compressed air which is supplied from the air compressor 150. The cooling water then passes through the cooling water supply tube 140 into the spray pipe 8.

The water which is warmed after the above cooling operation is discharged from the outlet 144 and passes through the warmed water return tube 146 and reaches the three port valve 148. By opening the three port valve 148, the powder-like refractory material from the refractory-material storage tank 36 and the warm water from spray pipe 8 are mixed together forming refractory material in a wet slurry form at the junction where the return tube 146 and the flexible hose 16 meet. The thus produced slurry-like refractory material is supplied to spray pipe 8 and finally is sprayed from the spray nozzle 14 onto the inner surface of the furnace.

In the above operation, the spray pipe 8 is manipulated by the rotating mechanism, the feeding mechanism, the tilting mechanism and the turntable 26 such that the spray nozzle 14 secured to the extremity of the spray pipe 8 is directed toward the abraded portion of the inner surface of a furnace. After above positioning of the spray nozzle 14, the spray pipe 8 is automatically oscillated by a desired rotating angle with the oscillating means disclosed heretofore.

Accordingly, the apparatus of this invention has the following advantages.

(1) Since the spray pipe 8 can be automatically oscillated, the spray nozzle can fully and easily cover the abraded or eroded portion of the inner surface of a furnace which has, in general, a considerable area.

(2) With the conventional apparatus, it is extremely difficult for an operator to effect two operations such as reciprocation and oscillation of the spray pipe simultaneously. Since above oscillating operation is conducted automatically in this invention, the operator can easily manipulate two operations, resulting in the improvement of the spraying operation.

(3) Since the spray nozzle is oscillated, refractory material is uniformly applied onto the entire area of abraded portion of a furnace.

(4) Since the oscillating angle can be adjusted, the optimal amount of refractory material can be sprayed onto the above abraded portion.

What is claimed is:

1. An apparatus for applying a refractory lining onto the inner surface of a furnace comprising:

(1) a transport car capable of moving on a floor, (2) a spray pipe with a spray nozzle from which refractory material is sprayed onto the inner side of said furnace, (3) a cylindrical body encasing said spray pipe slidably and rotatably, (4) a support means located on said transport car for pivotally supporting said cylindrical body and said spray pipe, (5) a control means comprising a pipe rotating means which imparts a rotation of said spray pipe relative to said cylindrical body and an automatic oscillating means which automatically effects a continuous rotary oscillation of said spray pipe within a predetermined angle relative to said cylindrical body, said automatic oscillating means comprising:

(a) first and second spaced apart ring-like plates mounted on said spray pipe adjacent to one end of said cylindrical body, (b) a selected number of circumferentially equidistant contact pads secured to the outer circular surface of said first ring-like plate which faces the corresponding surface of said second ring-like plate, said corresponding surface of said second plate also having a selected number of contact pads secured thereto, and (c) a limit switch provided with two contact levers mounted on said cylindrical body, each of which lever is adapted to contact the contact pads of one of said ring-like plates so as to switch on and off said limit switch and thereby effect the rotation of said outer pipe relative to said cylyndrical body in alternately opposed directions, and (6) a tank storing refractory material therein and including a means for supplying said refractory material to said spray pipe from said tank.

2. An apparatus for applying a refractory lining onto the inner surface of a furnace comprising:

(1) a transport car capable of moving on a floor, (2) a spray pipe with a spray nozzle from which refractory material is sprayed onto the inner side of said furnace, (3) a cylindrical body encasing said spray pipe slidably and rotatably, (4) a support means located on said transport car for pivotally supporting said cylindrical boday and said spray pipe, (5) a control means comprising a pipe rotating means which imparts a rotation of said spray pipe relative to said cylindrical body and an automatic oscillating means which automatically effects a continuous rotary oscillation of said spray pipe within a predetermined angle relative to said cylindrical body, said automatic oscillating means comprising:

(a) a pair of timers for presetting rotation times of said spray pipe, one for a clockwise direction and the other for a counter-clockwise direction, (b) a start button for initiating the actuation of either of said timers, a control box receiving a direction signal from said timers and transforming said direction signal to an operation signal for operating said pipe rotating means, and (c) a signal transmitting means comprising a first line which transmits said direction signal from said clockwise and counterclockwise rotation timers alternately to said control box and a second line which transmits said operation signal from said control box to said pipe rotating means, and (6) a tank storing refractory material therein and including a means for supplying said refractory material to said spray pipe from said tank.

3. An apparatus for applying a refractory lining onto the inner surface of a furnace comprising:

(1) a transport car capable of moving on a floor, (2) a spray pipe with a spray nozzle from which refractory material is sprayed onto the inner side of said furnace, (3) a cylindrical body encasing said spray pipe slidable and rotatably, p1 (4) a support means located on said transport car for pivotally supporting said cylindrical body and said spray pipe, (5) a control means comprising a pipe rotating means which imparts a rotation of said spray pipe relative to said cylindrical body and an automatic oscillating means which automatically effects a continuous rotary oscillation of said spray pipe within a predetermined angle relative to said cylindrical body, said oscillating means comprising:

(a) a toothed wheel concentrically secured to said spray pipe, (b) a limit switch secured onto said cylindrical body in an upright position, said limit switch having a roller follower thereof disposed to contact the toothed surface of said wheel such that said follower repeats an up-and-down movement with the rotation of said wheel, (c) a counter means for counting the number of said up-and-down movements of said roller follower, said counter means, after a preset number of said movements, sending an operation signal, and (d) a signal transferring means comprising a first line which transmits said count number to said counter and a second line which transmits said operation signals for clockwise rotation and for counter-clockwise rotation to said pipe rotating means alternately, and (6) a tank storing refractory material therein and including a means for supplying said refractory material to said spray pipe from said tank.

* * * * *